US006940458B2

(12) United States Patent
Mukai et al.

(10) Patent No.: US 6,940,458 B2
(45) Date of Patent: Sep. 6, 2005

(54) ELECTRONIC EQUIPMENT AND ANTENNA MOUNTING PRINTED-CIRCUIT BOARD

(75) Inventors: Kouichi Mukai, Ishikawa (JP); Shuichiro Yasuda, Ishikawa (JP); Kenji Asakura, Ishikawa (JP); Hidenobu Muranaka, Ishikawa (JP)

(73) Assignee: Sony Chemicals Corporation Neagari Plant, Ishikawa (JP)

( * ) Notice: Subject to any disclaimer, the term of this patent is extended or adjusted under 35 U.S.C. 154(b) by 79 days.

(21) Appl. No.: 10/721,671

(22) Filed: Nov. 25, 2003

(65) Prior Publication Data

US 2004/0145528 A1 Jul. 29, 2004

(30) Foreign Application Priority Data

Jan. 23, 2003 (JP) ..... 2003-015385
Jan. 28, 2003 (JP) ..... 2003-019435

(51) Int. Cl.[7] ..... H01Q 1/38; H01Q 1/24; H01Q 1/48

(52) U.S. Cl. ..... 343/700 MS; 343/702; 343/829; 343/846; 343/853

(58) Field of Search ..... 343/700 MS, 702, 343/829, 845, 846–848, 853, 893, 895, 737; H01Q 1/38, 1/24, 1/48

(56) References Cited

U.S. PATENT DOCUMENTS 6,549,169 B1 * 4/2003 Matsuyoshi et al. ..... 343/702
2001/0053672 A1 * 12/2001 Masaki ..... 455/90
2004/0036653 A1 * 2/2004 Ishihara et al. ..... 343/700 MS
2004/0227669 A1 * 11/2004 Okado ..... 343/700 MS

FOREIGN PATENT DOCUMENTS

JP 05-347509 12/1993 ..... H01Q/13/08
JP 2002-118411 4/2002 ..... H01Q/1/40

* cited by examiner

*Primary Examiner*—Trinh Vo Dinh
(74) *Attorney, Agent, or Firm*—Welsh & Katz, Ltd.

(57) ABSTRACT

A PDA includes a printed-circuit board on which at least one printed antenna pair having two chip-like printed antennas, which receive linearly polarized signals and are disposed along axes orthogonal to each other, is mounted. In each of the printed antennas, an open end is formed of at least two antenna conductors separated from each other. Besides, in the printed-circuit board, a ground required by one or plural other modules is disposed so as to surround a surrounding area of at least three sides of four sides forming a rectangular section in each of the printed antennas, and each of the printed antennas is disposed and mounted so that a remaining one side faces an edge portion of the printed-circuit board. While the PDA can receive circularly polarized signals very effectively, the degree of freedom in layout is greatly expanded and miniaturization can be realized.

18 Claims, 17 Drawing Sheets

ELECTRONIC EQUIPMENT AND ANTENNA MOUNTING PRINTED-CIRCUIT BOARD

TECHNICAL FIELD

The present invention relates to an electronic equipment having at least a communication function and an antenna mounting printed-circuit board incorporated in the electronic equipment.

BACKGROUND

In recent years, for example, like a mobile communication unit such as a cellular phone, or a wireless LAN (Local Area Network) based on the so-called IEEE (Institute of Electronic and Electronics Engineers) 802.11 standard, various wireless communication techniques have been remarkably developed, and in accordance with this, various techniques concerning an antenna element as an inevitably provided member in order to perform wireless communication have also been developed.

As an antenna element, for example, one in which a radiation electrode, a surface electrode or the like is formed on a cylindrical dielectric is known. This kind of antenna element is generally installed at the outside of an equipment body and is used. However, in the antenna element of such a type that it is disposed at the outside and is used, there are problems that miniaturization of the equipment is obstructed, high mechanical strength is required, and the number of parts is increased.

Then, as an antenna element substituting for this, a chip-like antenna element which can be surface-mounted on a printed-circuit board provided in the inside of an equipment body has been proposed.

As the chip-like antenna element, various ones, for example, a so-called reverse F-type antenna in which a conductor as a radiation electrode is formed into a reverse F shape, and a so-called helical antenna in which a conductor is formed into a coil shape, have been proposed. In such a chip-like antenna element, what is formed by using a high dielectric constant material, such as ceramic, as a base member is typical. However, in this kind of antenna element, there are defects that the high dielectric constant material itself is expensive, and the working thereof is troublesome, and there are problems that the productivity lowers and the manufacture cost increases.

Then, in recent years, with the improvement of a photoetching technique, for the purpose of resolving the disadvantages as stated above, a so-called printed antenna is proposed in which a printed-circuit board having copper foils on both sides is used as a base member, and the photoetching technique is used to form an antenna conductor on this (for example, see patent document 1: JP-A-5-347509, and patent document 2: JP-A-2002-118411).

The patent document 1 discloses a printed antenna in which an antenna conductor layer including at least a loop-shaped conductor part is formed by using an upper side copper foil of a both-sided substrate, an earth conductor layer is formed by using a lower side copper foil, and an insulating material part between the upper and lower copper foils of the both-sided substrate is used as a dielectric layer. In this printed antenna, a feeding part is formed of the copper foil at the side of the earth conductor layer while being insulated from the earth conductor layer, and the loop-shaped conductor part of the antenna conductor layer and the earth conductor layer are connected to each other by a grounding conductor through the dielectric layer. Besides, in this printed antenna, a feeding conductor is made to face on the inside of the loop-shaped conductor part from the feeding part through the dielectric layer, and a series resonant circuit including an inductance element and a capacitor element to cancel the reactance of an antenna body part and to broaden the band width is provided between the feeding conductor and the loop-shaped conductor part. The patent document 1 describes that by constructing the printed antenna as stated above, the band width can be broadened by using the reactance compensation method, the total combination adjustment after manufacture can be made unnecessary, and a drop in antenna gain can be reduced.

Besides, the patent document 2 discloses a helical antenna in which plural through holes are formed alternately in parallel on a printed-circuit board, and ends of these through holes are connected so as to form a spiral as a whole. This patent document 2 describes that an antenna element for a small mobile communication unit can be provided by constructing the helical antenna as stated above.

By the way, in recent years, also in a portable electronic equipment such as a so-called personal digital assistance (hereinafter referred to as a PDA), in order to enable access to a network such as the Internet from, for example, a place where one has gone, a wireless communication function such as the foregoing wireless LAN of the IEEE802.11 standard is added.

In such an electronic equipment, since transmission/reception of signals is performed while being carried, there is a fear that polarization planes become different between a transmission side of the signals and a reception side, and there is a case where reception at the reception side becomes difficult. Thus, in the electronic equipments, in order to enable the reception even when the polarization planes are not identical to each other between the transmission side and the reception side, there are many cases where antenna elements for performing transmission/reception of signals of circular polarization, not so-called linear polarization, are mounted.

As the antenna element to enable the transmission/reception of the circularly polarized signals, there is a so-called patch antenna. As a specific example of an electronic equipment on which the patch antenna is mounted, a description will be given while using a PDA 200 whose plan view and sectional view seen from below are shown in FIG. 1.

As shown in the drawing, the PDA 200 has a substantially rectangular chassis and is constructed such that two patch antennas 201*a* and 201*b* capable of transmitting/receiving circularly polarized signals are disposed in areas in the vicinities of two corners facing each other on a specified circuit board 202 provided in the inside of the chassis. Incidentally, the two patch antennas 201*a* and 201*b* are disposed from the viewpoint of directional diversity, and the PDA 200 may be provided with only one of the patch antennas.

The PDA 200 as stated above can transmit/receive the circularly polarized signals by using the patch antennas 201*a* and 201*b*, and is enabled to perform wireless communication without changing the polarization plane between the transmission side and the reception side.

However, in recent years, when an electronic equipment performing wireless communication, including a mobile communication unit such as a PDA, is developed, importance has been attached to miniaturization.

Here, when the PDA 200 is used as an example, the patch antenna 201*a*, 201*b* has a main plane of about 20 mm×20 mm and a length of about 4 mm to 5 mm in its thickness direction. Thus, in the PDA 200, in order to mount the patch antennas 201*a* and 201*b* having large areas, the degree of freedom in the layout on the circuit board, on which other not-shown various modules must be mounted, is extremely limited, and since the chassis for housing the member having the thickness of about 4 mm to 5 mm must be used, especially the length in the thickness direction becomes large, which has obstructed miniaturization.

SUMMARY OF THE INVENTION

The present invention has been made in view of the circumstances as stated above, and has an object to provide an electronic equipment and an antenna mounting printed-circuit board, in which while a circularly polarized signal can be transmitted and received very effectively, the degree of freedom in layout is greatly expanded, and great miniaturization can be realized.

An electronic equipment of the invention to achieve the foregoing object is an electronic equipment having at least a communication function, includes a printed-circuit board on which at least one antenna element pair including two chip-like antenna elements, each of which receives a linearly polarized signal and which are disposed along axes orthogonal to each other, and various modules for realizing various functions are mounted, and is characterized in that each of the antenna elements has a thin plate shape having a rectangular section, an open end is formed by at least two antenna conductors separated from each other, a ground required by one or plural other modules is disposed to surround a surrounding area of at least three sides of four sides forming the rectangular section in each of the antenna elements, and the antenna elements are disposed and mounted so that a remaining one side of the four sides forming the rectangular section in each of the antenna elements faces an edge portion of the printed-circuit board.

In the electronic equipment of the invention as stated above, the at least one antenna element pair in which the two antenna elements receiving the linearly polarized signals are disposed along the axes orthogonal to each other is mounted, so that especially the length in the thickness direction can be reduced, and while a signal can be received under the same characteristic as the conventional antenna element receiving the circularly polarized signal, great miniaturization can be realized.

Besides, in the electronic equipment of the invention as stated above, as the antenna element, one in which the open end is formed by the at least two antenna conductors separated from each other is mounted, so that it is possible to generate a relatively large capacitance at the open end. Thus, in the electronic equipment of the invention, since it is possible to suppress the variation of resonance frequency in the antenna element to such a degree that it can be neglected, so that resistance to the influence of ground existing in the surroundings can be made very high, rather, a ground is disposed in the vicinity, and it becomes possible to perform matching by using this ground. Then, in the electronic equipment of the invention, the ground is disposed to surround the surrounding area of the at least three sides of the four sides forming the rectangular section in the antenna element as stated above, so that the directivity of the antenna element can be controlled in a specified direction, the effects of not only spatial diversity but also directional diversity are obtained, and interference due to the mounting of the plural antenna elements can be reduced.

Here, the two antenna elements constituting the antenna element pair are respectively constructed to transmit and/or receive linearly polarized signals having different polarization planes, and more specifically, they are constructed to transmit and/or receive the linearly polarized signals having polarization planes orthogonal to each other.

Besides, one antenna element of the two antenna elements constituting the antenna element pair receives a first signal of linear polarization, and the other antenna element receives a second signal of linear polarization having a phase different from the first signal by 90°.

Further, as the antenna element, one in which the at least two antenna conductors are separated from each other in a height direction can be used.

Furthermore, the electronic equipment of the invention is characterized in that each of the antenna elements is constructed such that a conductor pattern having a three-dimensional structure is formed in a specified resin substrate.

In the electronic equipment of the invention as stated above, the conductor pattern of the antenna element is made to have the three-dimensional structure, so that even in the case where the antenna element is constructed by using a substrate having a low dielectric constant, it does not become large, and narrowing of a band width can also be avoided. Besides, in the electronic equipment of the invention, it is possible to resolve also the problem that impedance is lowered due to the occurrence of capacitance at the open end of the antenna element.

Specifically, as each of the antenna elements, one is used in which plural antenna conductors are connected to each other to enable electrical conduction through one or plural through holes, which are provided to be bored through the resin substrate from the front surface to the rear surface and the insides of which are coated with copper foils, so that the conductor pattern is formed. Especially, as the antenna element, it is desirable that the plural antenna conductors are connected to have a meandering shape through the one or plural through holes so that the conductor pattern is formed. Incidentally, as the above resin substrate, one made of a glass cloth epoxy substrate may be used.

Besides, an antenna mounting printed-circuit board of the invention to achieve the foregoing object is an antenna mounting printed-circuit board which is incorporated in an equipment having at least a communication function and on which various modules for realizing various functions are mounted, and is characterized in that at least one antenna element pair in which two chip-like antenna elements each receiving a linearly polarized signal are disposed along axes orthogonal to each other, and a ground disposed to surround a surrounding area of at least three sides of four sides forming a rectangular section in each of the antenna elements each having a thin plate shape with a section of a rectangular shape and required by one or plural other modules are mounted, an open end of each of the antenna elements is formed of at least two antenna conductors separated from each other, and a remaining one side of the four sides forming the rectangular section is disposed to face an edge portion of the printed-circuit board.

In the antenna mounting printed-circuit board of the invention as stated above, the at least one antenna element pair is mounted in which the two antenna elements each receiving the linearly polarized signal are disposed along the axes orthogonal to each other, so that especially the length in the thickness direction can be reduced, and while the signals can be received under the same characteristic as the conventional antenna element receiving the circularly polarized signals, it contributes to great miniaturization of an equipment in which it is to be incorporated.

Besides, in the antenna mounting printed-circuit board of the invention, as the antenna element, one in which the open end is formed of at least two antenna conductors separated from each other is mounted, so that a relatively large capacitance can be generated at the open end. Thus, in the antenna mounting printed-circuit board of the invention, since the variation of a resonant frequency in the antenna element can be suppressed to such a degree that it can be neglected, resistance to the influence of ground existing in the surroundings can be made very high, rather, a ground is disposed in the vicinity, and matching can be performed by using this ground. Then, in the antenna mounting printed-circuit board of the invention, the ground is disposed to surround the surrounding area of the at least three sides of the four sides forming the rectangular section in the antenna element, so that the directivity of the antenna element can be controlled in a specified direction, the effects of not only spatial diversity but also directional diversity can be obtained, and interference due to the mounting of the plural antenna elements can be reduced.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

In this written description, the use of the disjunctive is intended to include the conjunctive. The use of definite or indefinite articles is not intended to indicate cardinality. In particular, a reference to "the" object or thing or "an" object or "a" thing is intended to also describe a plurality of such objects or things.

Hereinafter, a specific embodiment to which the invention is applied will be described in detail with reference to the drawings.

This embodiment is an electronic equipment having at least a communication function such as, for example, a wireless LAN (Local Area Network) according to the so-called IEEE (Institute of Electronic and Electronics Engineers) 802.11 standard. This electronic equipment incorporates a specified printed-circuit board on which a chip-like antenna element, referred to as a so-called printed antenna, in which an antenna conductor is patterned and formed on a specified resin substrate as a base member is mounted.

Here, as this antenna element, one singly transmitting and receiving a so-called linearly polarized signal is used. In the electronic equipment, at least two such antenna elements are prepared, and these antenna elements are respectively disposed to transmit/receive signals, so that while a circularly polarized signal can be transmitted and received, the degree of freedom in layout is greatly expanded, and great miniaturization can be realized. Besides, this electronic equipment enables the transmission/reception of the circularly polarized signal and incorporates, as the antenna element, the printed antenna which is not easily influenced by ground existing in the surroundings, rather actively uses the ground existing in the surroundings to perform matching, and realizes superior directivity, and accordingly, the effects of not only spatial diversity but also directional diversity are obtained, the interference due to the mounting of the plural printed antennas is reduced, and very effective transmission/reception can be performed.

Incidentally, in the following, a description will be given while using a so-called personal digital assistance (hereinafter referred to as a PDA) as a specific example of the electronic equipment for convenience of explanation. Besides, in general, since an antenna for transmission and an antenna for reception mutually have reversible properties, in the following, for convenience of explanation, a description focusing on the reception of signals will be given.

Figure 1:
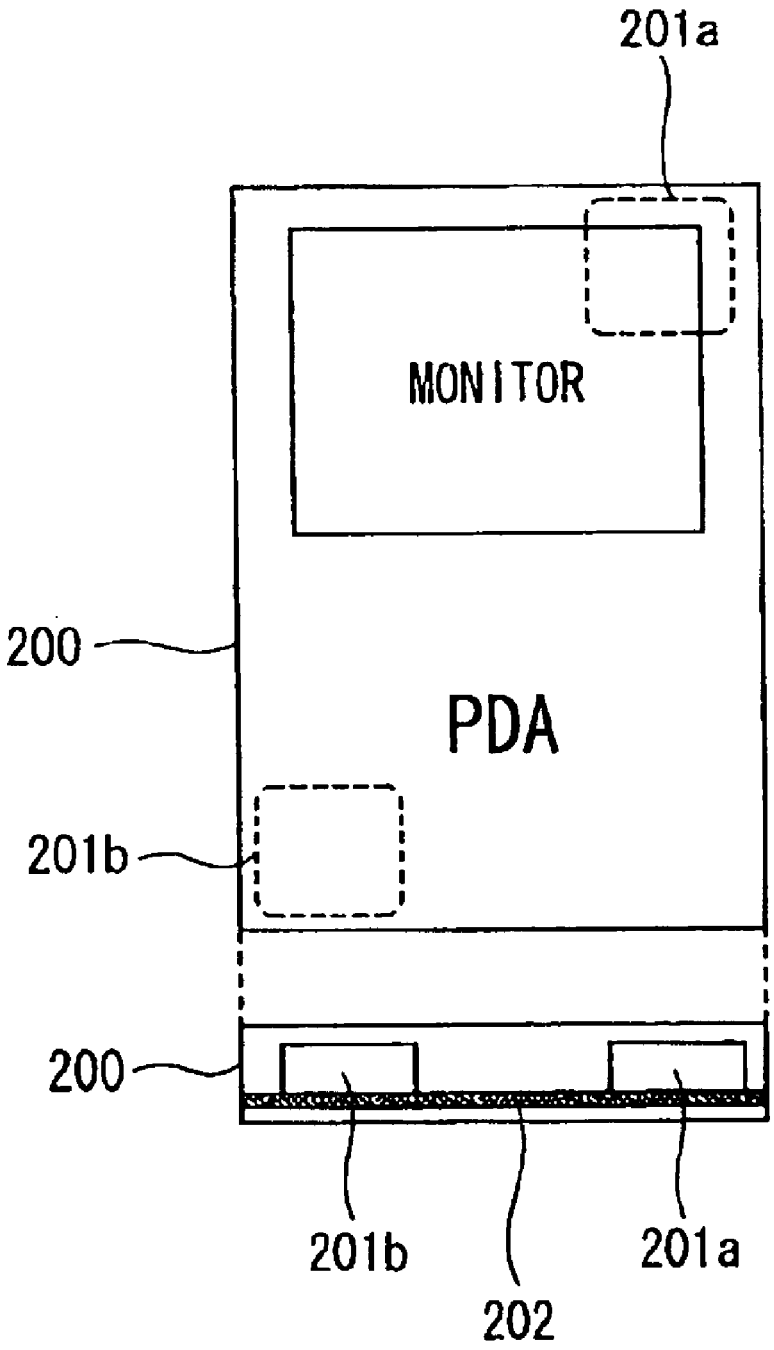
FIG. 1 is a plan view of a conventional PDA on which patch antennas are mounted and a sectional view seen from below.
Figure 2:
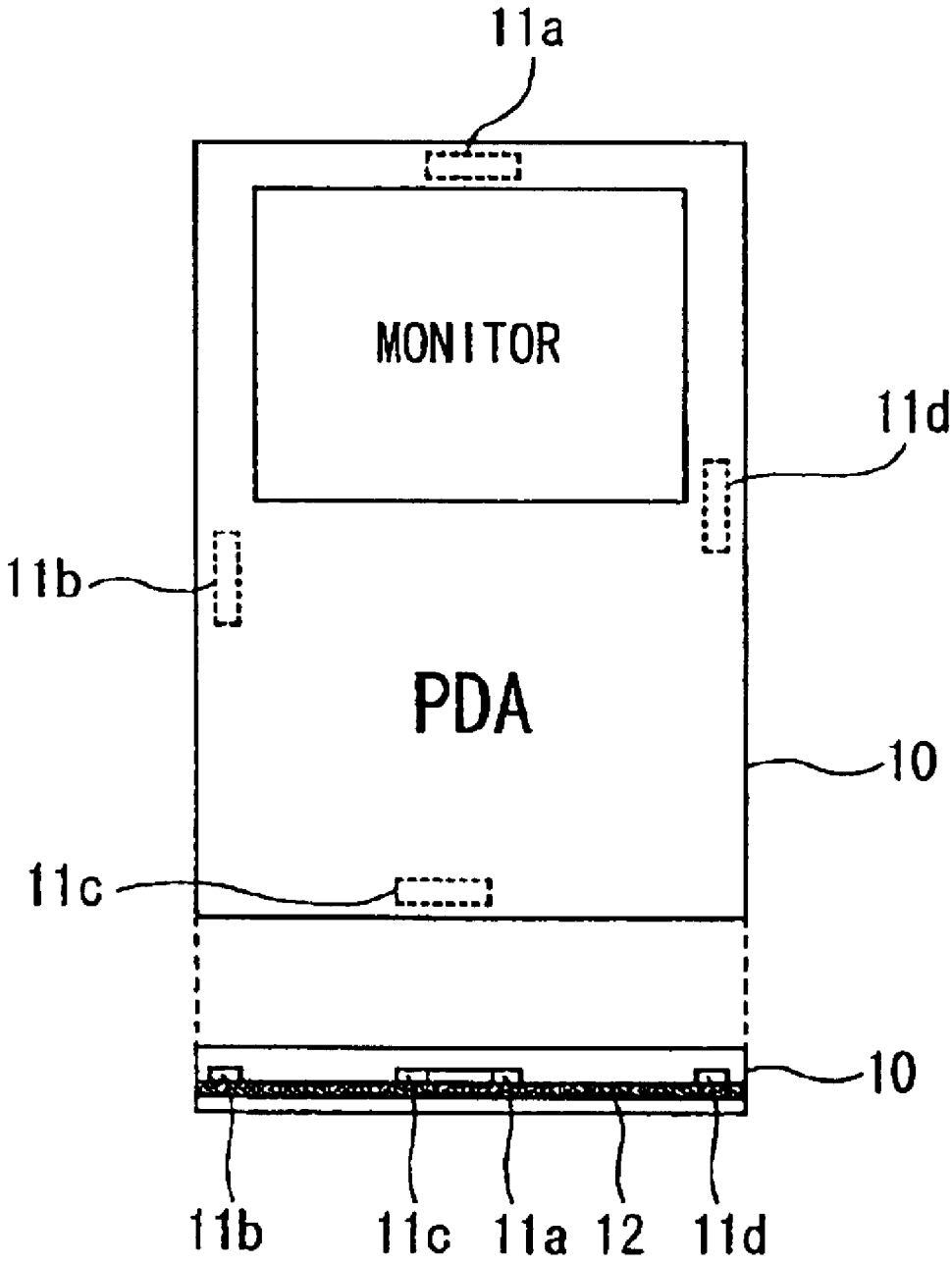
FIG. 2 is a plan view of a PDA shown as an embodiment of the invention and a sectional view seen from below.

As shown in a plan view and a sectional view seen from below of FIG. 2, a PDA 10 has a substantially rectangular chassis, and four printed antennas 11*a*, 11 *b*, 11*c* and 11*d*, each receiving a linearly polarized signal, together with one or plural not-shown other modules for realizing functions of the PDA 10, such as, for example, an RF (Radio Frequency) module, are mounted on a specified printed-circuit board 12 incorporated in the inside of the chassis.

Each of these four printed antennas 11*a*, 11*b*, 11*c* and 11*d* has a main plane showing a rectangular shape of a size of, for example, 3 mm×8.8 mm, has a length of, for example, about 0.6 mm in a thickness direction, and is disposed so that a long side of the main plane faces an edge portion of the printed-circuit board 12. That is, in the PDA 10, the two printed antennas 11*a* and 11*b* are respectively disposed along axes orthogonal to each other, so that signals having different polarization planes can be received by the respective printed antennas 11*a* and 11*b*.Besides, similarly, in the PDA 10, the two remaining printed antennas 11*c* and 11*d* are disposed along axes orthogonal to each other, so that signals having different polarization planes can be received by the respective printed antennas 11*c* and 11*d*.

Here, since a circularly polarized wave is formed by shifting the phases of a horizontal polarized wave and a vertical polarized wave by 90° and combining them, attention is paid to a fact that when two antenna elements receiving linearly polarized signals having polarization planes orthogonal to each other are disposed along axes orthogonal to each other, and signals having phases shifted by 90° are given, a circularly polarized signal can be received. This is based on the same principle as a so-called turnstile antenna in which so-called dipole antennas are disposed to be cross-shaped while the phases are shifted from each other by 90°.

Accordingly, the PDA 10 is constructed such that the printed antenna 11*a* receives a first signal, and the printed antenna 11*b* receives a second signal having a phase different from the first signal by 90°, and further, the printed antenna 11*c* receives the first signal, and the printed antenna 11*d* receives the second signal. That is, in the PDA 10, each of a printed antenna pair made of the two printed antennas 11*a* and 11*b*, and a printed antenna pair made of the two printed antennas 11*c* and 11*d* has a function corresponding to one patch antenna receiving a circularly polarized signal. By this, the PDA 10 has at least the effect of spatial diversity by the four printed antennas 11*a*, 11*b*, 11*c* and 11*d* and can further receive the circularly polarized signal.

Figure 3:
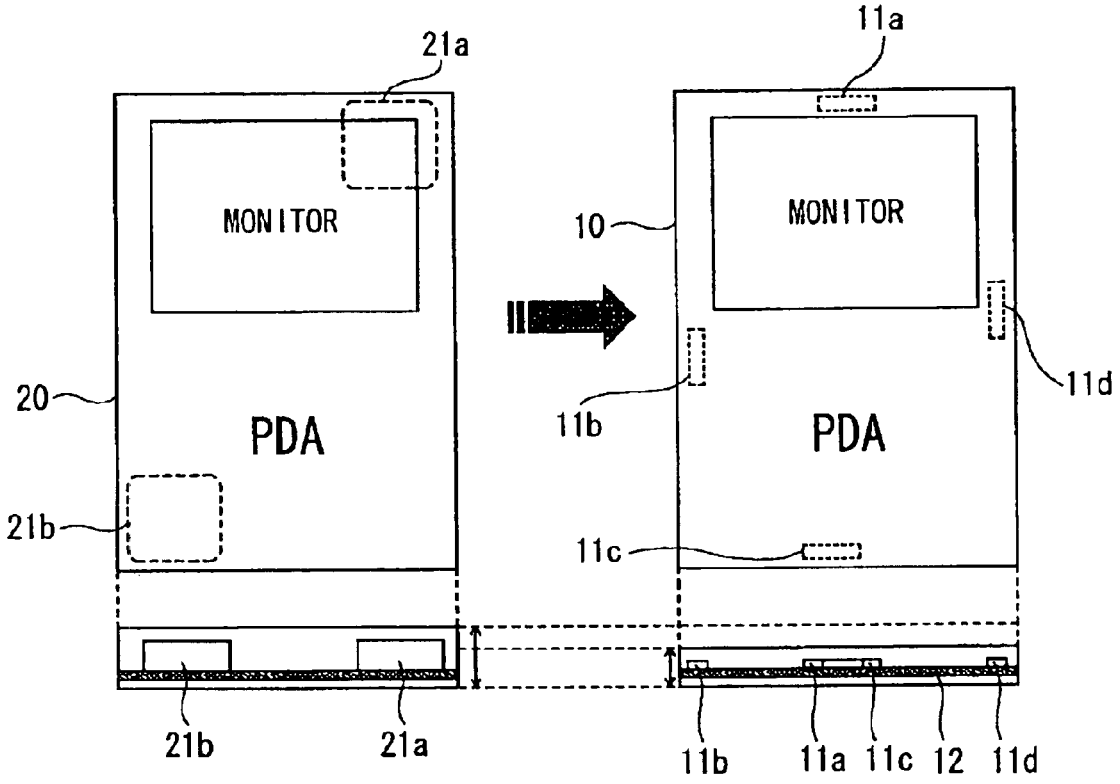
FIG. 3 is a plan view of the PDA shown in FIG. 2 and the conventional PDA provided with the two patch antennas and a sectional view seen from below, and is the views for comparing these two PDAs.

In the PDA 10 including the printed antennas 11*a*, 11*b*, 11*c* and 11*d* as stated above, since the printed antennas 11*a*, 11*b*, 11*c* and 11*d* are constructed by a thickness of about 0.6 mm as described above, as shown in FIG. 3, as compared with a conventional PDA 20 including two patch antennas 21*a* and 21*b* having similar reception characteristics, it can be formed to be thin, and great miniaturization can be realized.

Figure 4:
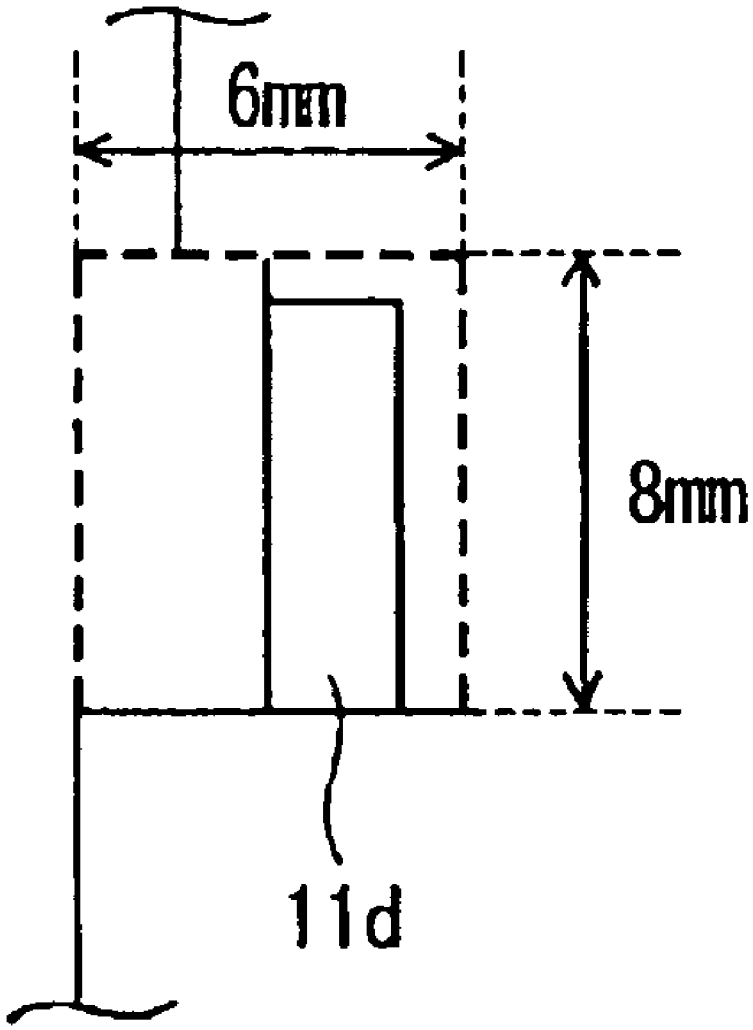
FIG. 4 is a main part plan view of a near area of one printed antenna mounted on the PDA shown in FIG. 2.

Besides, in the PDA 10, although the details will be described later, the printed antennas 11*a*, 11*b*, 11*c* and 11*d* are respectively disposed to be close to the ground. Accordingly, in the PDA 10, in the case where the size of the main plane of each of the printed antennas 11*a*, 11*b*, 11*c* and 11*d* is about 3 mm×8.8 mm as described above, an area for mounting each of the printed antennas 11*a*, 11*b*, 11*c* and 11*d* can be made an area of about 6 mm×8 mm as shown in FIG. 4 of a near area of the printed antenna 11*d*, an area which can be assigned to various other modules can be secured on the printed-circuit board having a limited area, the miniaturization can be realized, and the degree of freedom in layout can also be raised.

Now, although the PDA 10 can receive the circularly polarized signal by including the four printed antennas 11*a*, 11*b*, 11*c* and 11*d* as stated above, if nothing is done, a following problem remains.

Consideration will be given to a case where a printed antenna is mounted on a specified printed-circuit board. In general, the printed antenna is apt to be influenced by ground existing in the surroundings, and its characteristic is varied by the existence of the ground. Thus, in the printed-circuit board on which the printed antenna is mounted, in general, the layout on the printed-circuit board is designed such that the ground, that is, another metal body is not provided in a surrounding area of a place where the printed antenna is mounted. In other words, in the printed-circuit board, a dedicated land in which a ground required by various other modules does not exist is provided on the printed-circuit board, and the printed antenna is mounted on this land.

Figure 5:
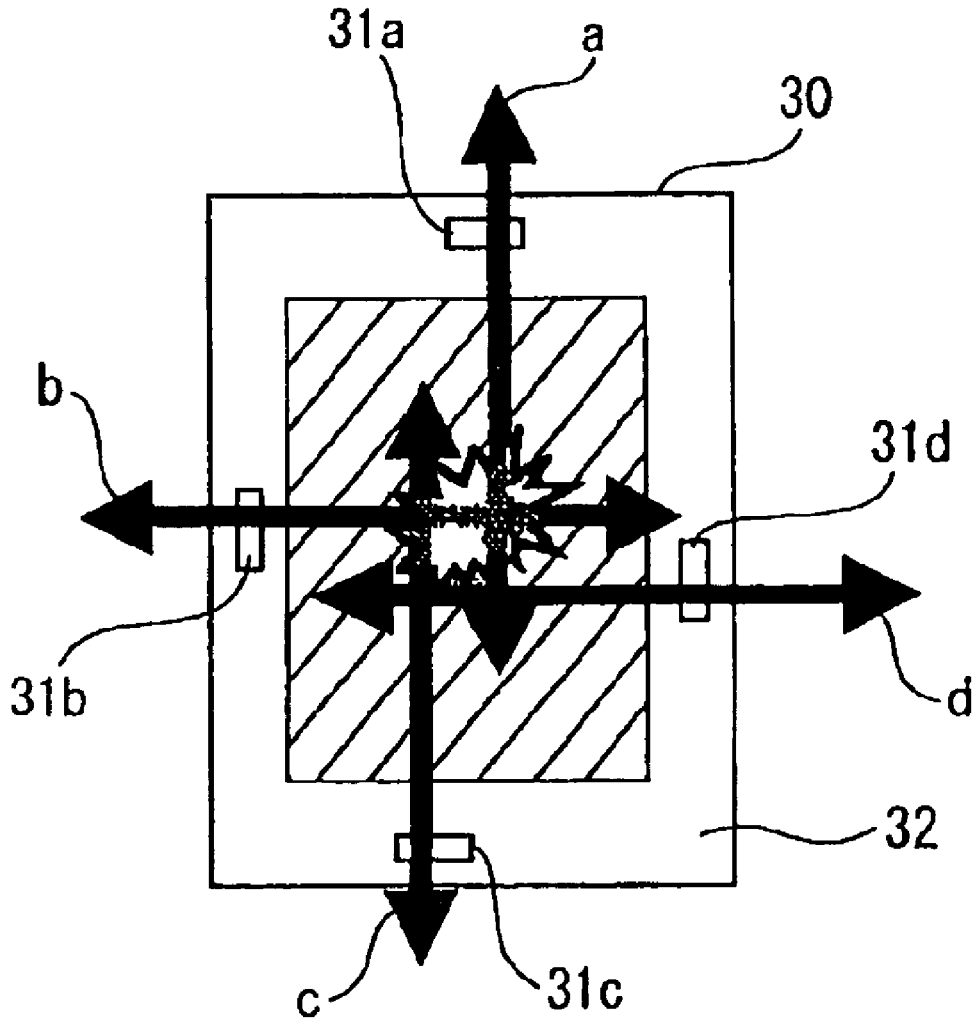
FIG. 5 is a plan view of a printed-circuit board on which four printed antennas are mounted and is the view for explaining a state in which the four printed antennas are mounted on a land provided along the outer periphery of the printed-circuit board so as to avoid ground.

Accordingly, as described above, in the case where four printed antennas are mounted on the printed-circuit board, they become, for example, as shown in FIG. 5. That is, four printed antennas 31*a*, 31*b*, 31*c* and 31*d* are mounted on a land 32 provided along the outer periphery of a printed-circuit board 30 so as to avoid a ground indicated by an oblique line part in the drawing. In this case, radiation electric fields radiated from the respective antennas 31*a*, 31*b*, 31*c* and 31*d* come to have an 8-shaped dipole mode.

Here, when consideration is given to diversity of a circularly polarized antenna formed by combining the linearly polarized printed antennas 31*a*, 31*b*, 31*c* and 31*d* which cause the directivity of a dipole type to occur on the printed-circuit board 30 as stated above, although the effect of the spatial diversity can be obtained, the effect of the directional diversity can be hardly obtained. This is because the directivity of the circularly polarized antenna by the printed antenna pair made of the printed antennas 31*a* and 31*b* and the directivity of the circularly polarized antenna by the printed antenna pair made of the printed antennas 31*c* and 31*d* become the same.

Besides, in the circularly polarized antennas formed by combining the printed antennas 31*a*, 31*b*, 31*c* and 31*d* as stated above, there is also a problem that from the relation of arrangement position of the printed antennas 31*a*, 31*b*, 31*c* and 31*d* and resonant directions, a situation occurs in which the two pairs of printed antennas forming the diversity interfere with each other. That is, resonance by the printed antenna 31*a* occurs in a direction indicated by an arrow a of the drawing, resonance by the printed antenna 31*b* occurs in a direction indicated by an arrow b of the drawing, resonance by the printed antenna 31*c* occurs in a direction indicated by an arrow c of the drawing, and resonance by the printed antenna 31*d* occurs in a direction indicated by an arrow d of the drawing, so that in the printed-circuit board 30, the interference occurs in a wide range in the vicinity of the center of the printed-circuit board 30.

Then, in order to avoid such a problem, as the printed antennas 11*a*, 11*b*, 11*c* and 11*d* mounted on the PDA 10 and the printed-circuit board on which these printed antennas 11*a*, 11*b*, 11*c* and 11*d* are mounted, ones described below are proposed.

First, prior to the explanation of the details of the printed-circuit board, the printed antennas 11*a*, 11*b*, 11*c* and 11*d* will be described with reference to FIGS. 6 to 9. Incidentally, in the following, in order to differentiate a printed-circuit board on which other modules for realizing the functions of the PDA 10, together with the printed antennas 11*a*, 11*b*, 11*c* and 11*d*, are mounted from a printed-circuit board used as a base member of the printed antennas 11*a*, 11*b*, 11*c* and 11*d*, the printed-circuit board used as the base member of the printed antennas 11*a*, 11*b*, 11*c* and 11*d* will be merely referred to as a substrate and the description will be made. Besides, in the following, for convenience of the description, the printed antennas 11*a*, 11*b*, 11*c* and 11*d* are generically referred to as a printed antenna 11 and the description will be made.

The printed antenna 11 can be constructed by using any kind of base member as long as it is generally used as a base member of a printed-circuit board. Specifically, the printed antenna 11 is constructed by using a so-called rigid substrate having copper foils at both sides, such as a paper phenol substrate defined by symbol XXP, XPC or the like according to National Electrical Manufacturers Association (NEMA), a paper polyester substrate defined by symbol FR-2, a paper epoxy substrate defined by symbol FR-3, a glass paper composite epoxy substrate defined by symbol CEM-1, a glass unwoven paper composite epoxy substrate defined by symbol CHE-3, a glass cloth epoxy substrate defined by symbol G-10, or a glass cloth epoxy substrate defined by symbol FR-4. Incidentally, among these, the glass cloth epoxy substrate (FR-4) having less hygroscopicity, less change in size, and self-anti-inflammatory is most desirable.

Figure 6:
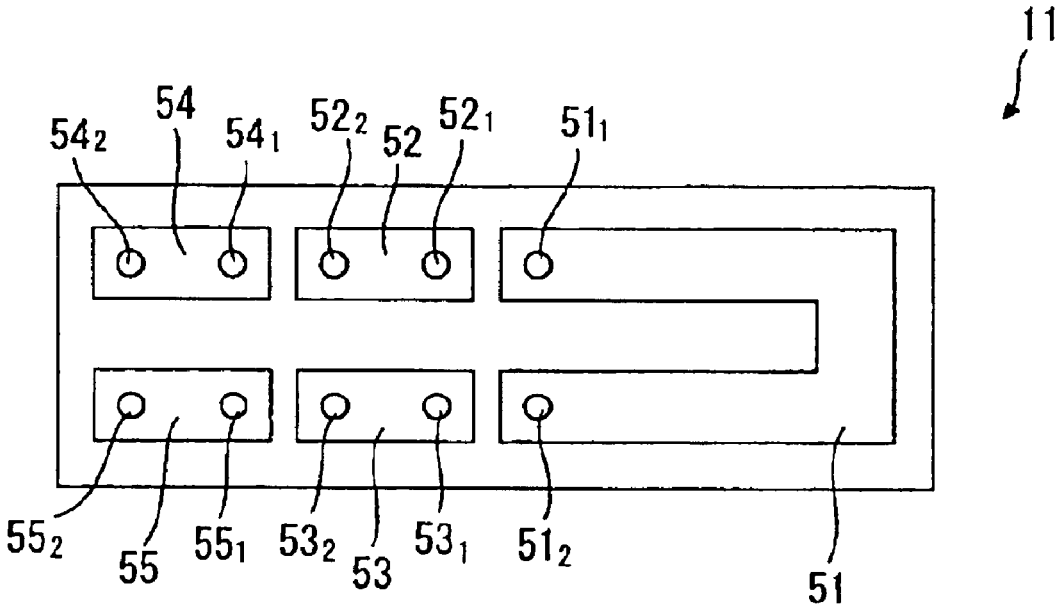
FIG. 6 is a plan view of a printed antenna mounted on a printed-circuit board to be incorporated in the PDA shown in FIG. 2.
Figure 7:
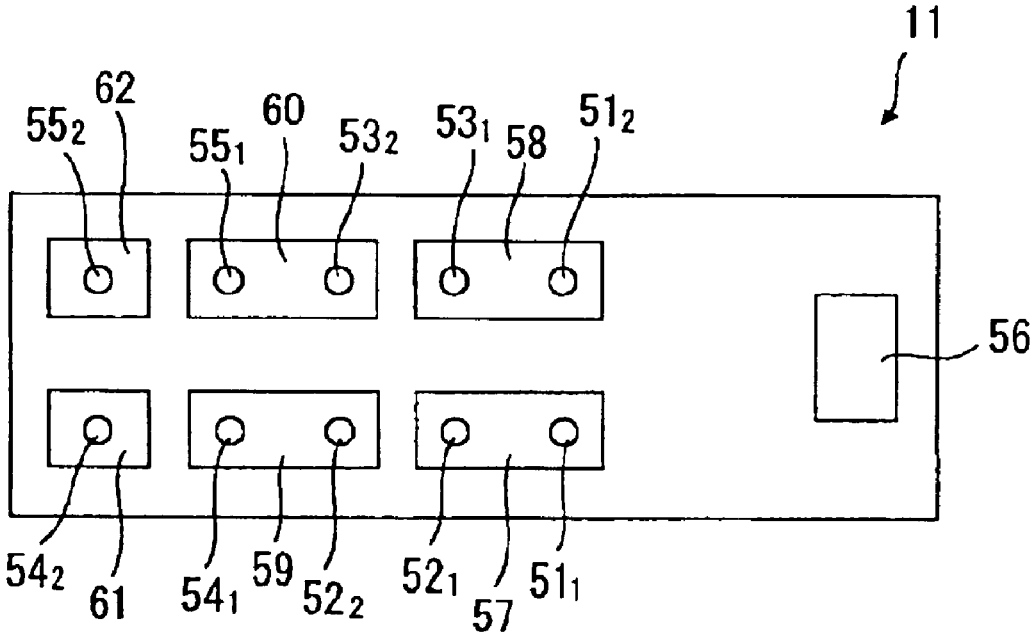
FIG. 7 is a bottom view of the printed antenna.

As shown in a plan view of FIG. 6, the printed antenna 11 is constructed such that as described above, a thin plate substrate having, for example, a rectangular shape is etched, so that plural antenna conductors 51, 52, 53, 54 and 55 as radiation electrodes are formed to be exposed on the front surface of the substrate. Specifically, in the printed antenna 11, the substantially C-shaped antenna conductor 51 and the rectangular antenna conductors 52, 53, 54 and 55 are formed on the substrate. Besides, as shown in a bottom view of FIG. 7, the printed antenna 11 is constructed such that plural rectangular antenna conductors 56, 57, 58, 59, 60, 61 and 62 as radiation electrodes are formed to be exposed on the back surface of the substrate. Among these, the antenna conductor 61 is used as a feeding electrode, and the antenna conductor 62 is used as a grounding electrode.

Further, in the printed antenna 11, plural through holes $\mathbf{51}_1$, $\mathbf{51}_2$, $\mathbf{52}_1$, $\mathbf{52}_2$, $\mathbf{53}_1$, $\mathbf{53}_2$, $\mathbf{54}_1$, $\mathbf{54}_2$, $\mathbf{55}_1$, and $\mathbf{55}_2$, the insides of which are plated with copper foils, are provided to be bored through the substrate from the front surface thereof to the back surface. Specifically, in the printed antenna 11, the through holes $\mathbf{51}_1$, $\mathbf{52}_1$, $\mathbf{52}_2$, $\mathbf{54}_1$ and $\mathbf{54}_2$ are bored in one line at substantially regular intervals, the through holes $\mathbf{51}_2$, $\mathbf{53}_1$, $\mathbf{53}_2$, $\mathbf{55}_1$ and $\mathbf{55}_2$ are bored in one line at substantially regular intervals, and a through hole group including the through holes $\mathbf{51}_1$, $\mathbf{52}_1$, $\mathbf{52}_2$, $\mathbf{54}_1$ and $\mathbf{54}_2$ and a through hole group including the through holes $\mathbf{51}_2$, $\mathbf{53}_1$, $\mathbf{53}_2$, $\mathbf{55}_1$ and $\mathbf{55}_2$ are arranged in parallel to each other.

Then, the through hole $\mathbf{51}_1$ is bored such that one end of the antenna conductor 51 provided on the front surface side of the substrate is made a starting point, and one end of the antenna conductor 57 provided on the back surface side is made an end point, and the through hole $\mathbf{51}_2$ is bored such that the other end of the antenna conductor 51 is made a starting point, and one end of the antenna conductor 58 provided on the back surface side is made an end point. Besides, the through hole $\mathbf{52}_1$ is bored such that one end of the antenna conductor 52 provided on the front surface side of the substrate is made a starting point, and the other end of the antenna conductor 57 is made an end point, and the through hole $\mathbf{52}_2$ is bored such that the other end of the antenna conductor 52 is made a starting point, and one end of the antenna conductor 59 provided on the back surface side is made an end point. Besides, the through hole $\mathbf{53}_1$ is bored such that one end of the antenna conductor 53 provided on the front surface side of the substrate is made a starting point, and the other end of the antenna conductor 58 is made an end point, and the through hole $\mathbf{53}_2$ is bored such that the other end of the antenna conductor 53 is made a starting point, and one end of the antenna conductor 60 provided on the back surface side is made an end point. Besides, the through hole $\mathbf{54}_1$ is bored such that one end of the antenna conductor 54 provided on the front surface side of the substrate is made a starting point, and the other end of the antenna conductor 59 is made an end point, and the through hole $\mathbf{54}_2$ is bored such that the other end of the antenna conductor 54 is made a starting point, and one end of the antenna conductor 61 provided on the back surface side is made an end point. Besides, the through hole $\mathbf{55}_1$ is bored such that one end of the antenna conductor 55 provided on the front surface side of the substrate is made a starting point, and the other end of the antenna conductor 60 is made an end point, and the through hole $\mathbf{55}_2$ is bored such that the other end of the antenna conductor 55 is made a starting point, and one end of the antenna conductor 62 provided on the back surface side is made an end point.

In other words, in the printed antenna 11, the antenna conductors 51 and 57 are connected to each other to enable electrical conduction through the through hole $\mathbf{51}_1$, and the antenna conductors 51 and 58 are connected to each other to enable electrical conduction through the through hole $\mathbf{51}_2$. Besides, in the printed antenna 11, the antenna conductors 52 and 57 are connected to each other to enable electrical conduction through the through hole $\mathbf{52}_1$, and the antenna conductors 52 and 59 are connected to each other to enable electrical conduction through the through hole $\mathbf{52}_2$. Besides, in the printed antenna 11, the antenna conductors 53 and 58 are connected to each other to enable electrical conduction through the through hole $\mathbf{53}_1$, and the antenna conductors 53 and 60 are connected to each other to enable electrical conduction through the through hole $\mathbf{53}_2$. Further, in the printed antenna 11, the antenna conductors 54 and 59 are connected to each other to enable electrical conduction through the through hole $\mathbf{54}_1$, and the antenna conductors 54 and 61 are connected to each other to enable electrical conduction through the through hole $\mathbf{54}_2$. Besides, in the printed antenna 11, the antenna conductors 55 and 60 are connected to each other to enable electrical conduction through the through hole $\mathbf{55}_1$, and the antenna conductors 55 and 62 are connected to each other to enable electrical conduction through the through hole $\mathbf{55}_2$. Accordingly, the printed antenna 11 is constructed such that the antenna conductors 51, 52, 53, 54, 55, 57, 58, 59, 60, 61 and 62 are connected to one another to enable electrical conduction.

Figure 8:
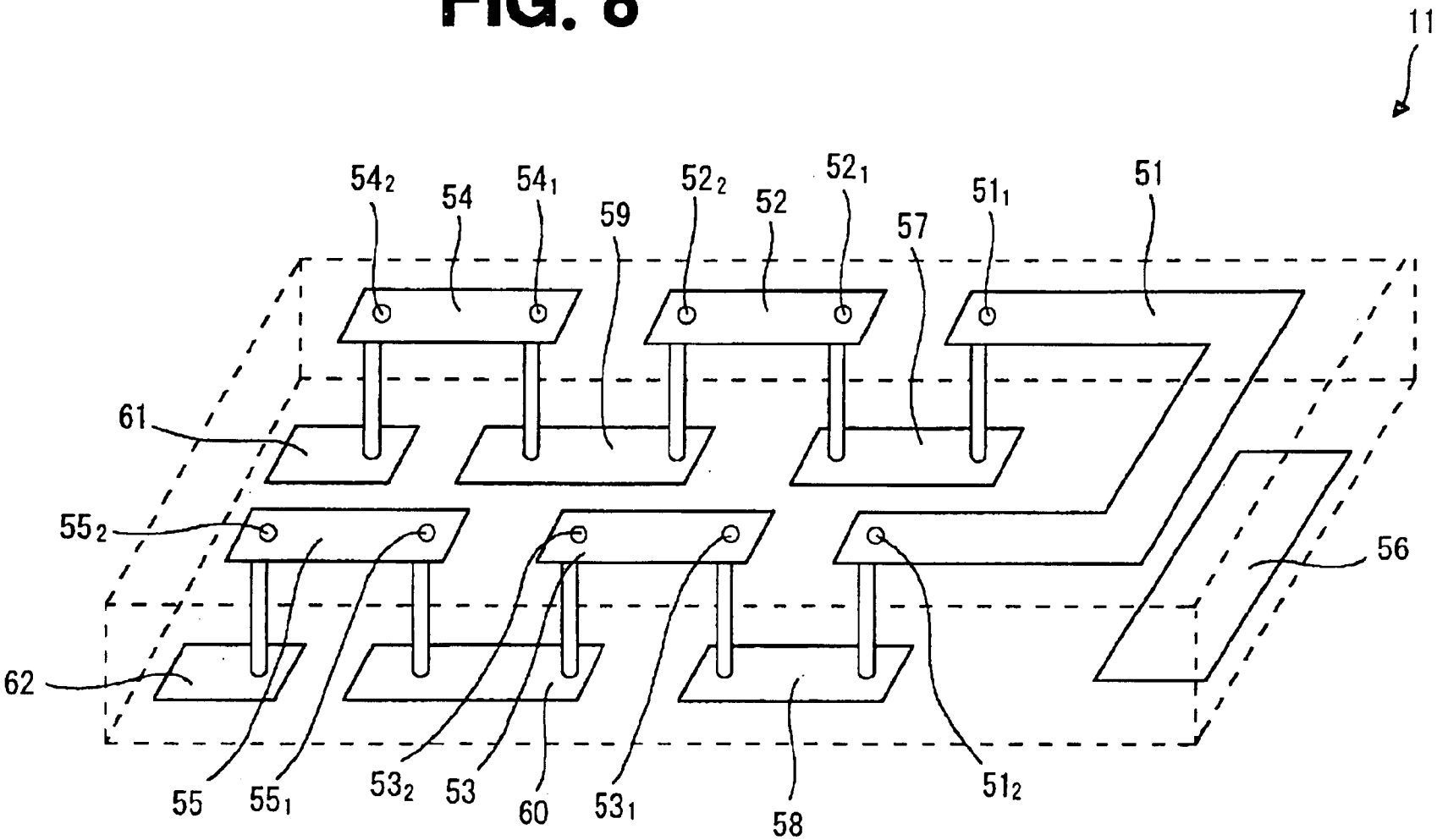
FIG. 8 is a perspective view for explaining a conductor pattern of the printed antenna in the inside of the board.
Figure 9:
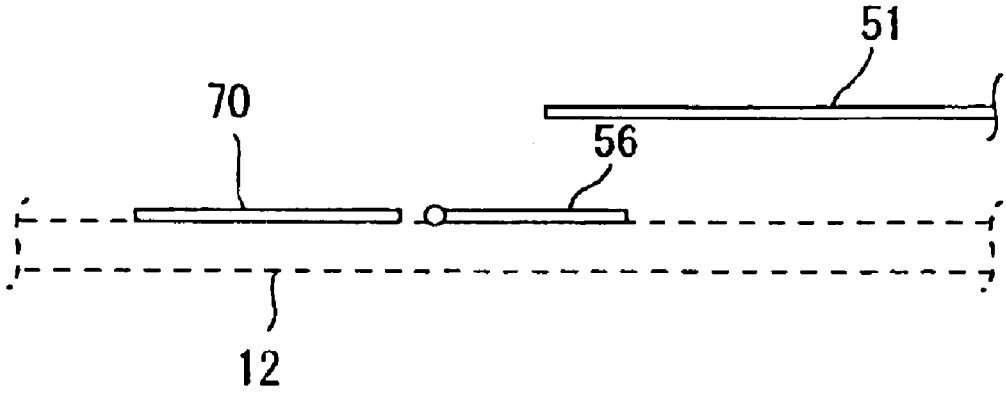
FIG. 9 is a cross-sectional view of the printed antenna and is the view for explaining an open end formed of two antenna conductors.

More specifically, as shown in FIG. 8 showing the inside of the substrate, the printed antenna 11 is constructed by forming a series of conductor patterns such that the plural antenna conductors 51, 52, 53, 54, 55, 57, 58, 59, 60, 61 and 62 connected in a meandering shape (comb teeth shape) through the plural through holes $\mathbf{51}_1$, $\mathbf{51}_2$, $\mathbf{52}_1$, $\mathbf{52}_2$, $\mathbf{53}_1$, $\mathbf{53}_2$, $\mathbf{54}_1$, $\mathbf{54}_2$, $\mathbf{55}_1$ and $\mathbf{55}_2$ are bent into substantially a C-shape with the antenna conductor 51 as the center.

In general, in the case where an antenna element is constructed by using a substrate having a low dielectric constant, in order to secure gain, a long conductor pattern must be formed in view of the influence of ground existing in the surroundings, and the antenna element becomes large in accordance with this. On the other hand, in the printed antenna 11, the conductor pattern having the three-dimensional structure is formed, so that the impedance can be increased up to such a value that the antenna can withstand the influence of the ground existing in the surroundings. Accordingly, the printed antenna 11 can be greatly miniaturized and made thin, and can also avoid the narrowing of the band width.

In the printed antenna 11 as stated above, the antenna conductors 51 and 56 are disposed to be separated from each other, so that an open end is formed. Specifically, in the printed antenna 11, as shown in a cross-sectional view of FIG. 9, the antenna conductor 56 is directly welded to a printed-circuit board 12 indicated by a broken line in the drawing through solder or the like, and the antenna conductor 51 is provided to be spatially separated from the antenna conductor 56 in a height direction by the thickness of the substrate. By this, in the printed antenna 11, a relatively large capacitance is generated between the antenna conductors 51 and 56.

Here, in the printed antenna 11, a maximum voltage is generated at the open end formed of the antenna conductors 51 and 56, and in the case where this open end is provided in the vicinity of another metal body 70 mounted as part of various modules, such as a grounding electrode, on the printed-circuit board 12, a stray capacitance is generated.

However, in the printed antenna 11, the antenna conductors 51 and 56 are separated from each other to actively form the large capacitance, and accordingly, even if fluctuation occurs in the distance between the antenna conductor 56 and the metal body 70, the variation of a resonant frequency can be suppressed to such a degree that it can be neglected. Accordingly, in the printed antenna 11, the resistance to the influence of a ground existing in the surroundings can be made very high, rather, a ground is disposed in the vicinity and this ground can be used to perform matching.

Incidentally, in the printed antenna 11, although the impedance is lowered due to the occurrence of the capacitance between the antenna conductors 51 and 56, as described above, the conductor pattern having the three-dimensional structure is formed, so that this problem can be resolved.

The printed antenna 11 as stated above is mounted on the printed-circuit board 12 by welding the back surface side, on which the antenna conductors 56, 57, 58, 59, 60, 61 and 62 are formed to be exposed, to the printed-circuit board 12 through solder or the like.

Now, in the following, the printed-circuit board 12 on which the printed antenna 11 as stated above is mounted will be described.

Figure 10:
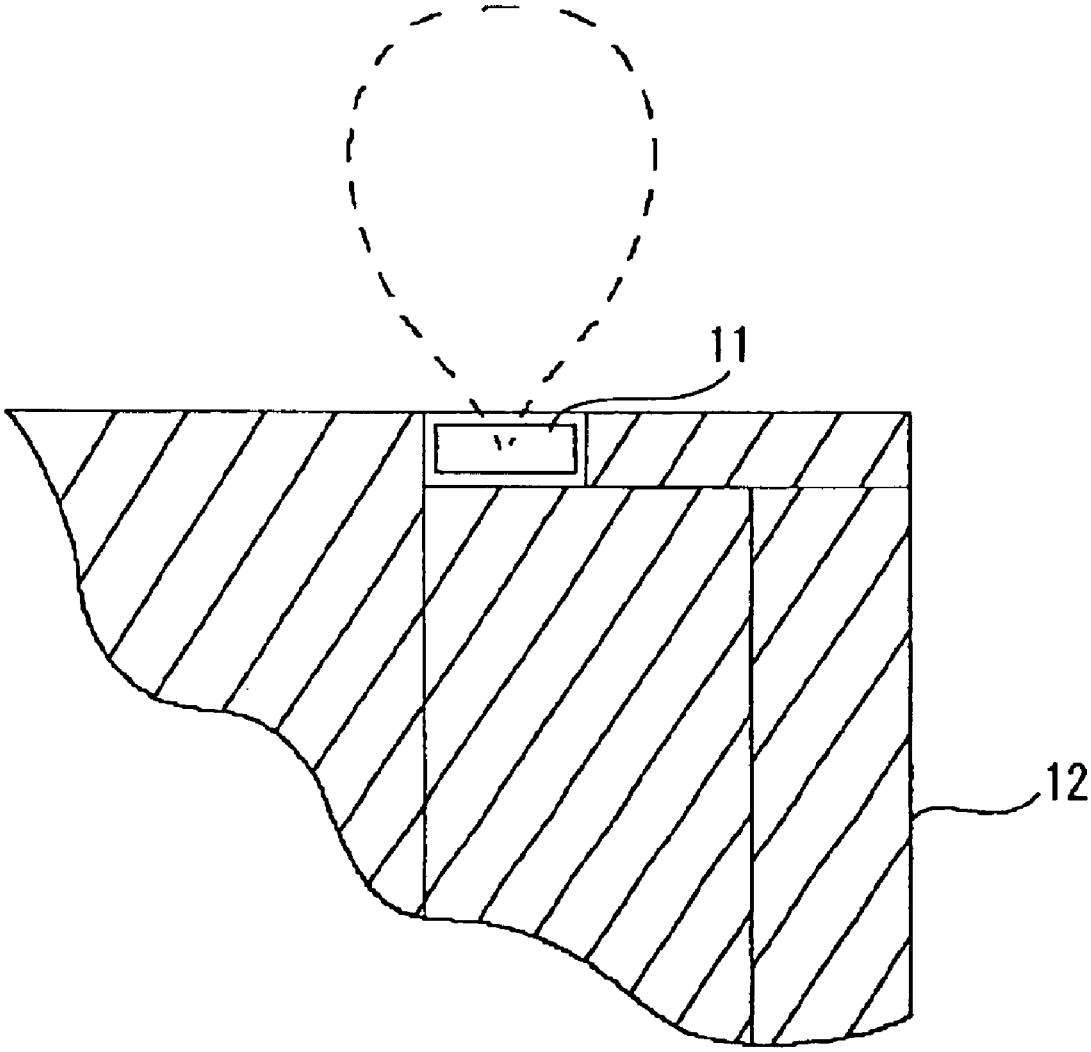
FIG. 10 is a plan view of a partial area in the printed-circuit board on which the printed antenna is mounted.

As described above, the printed antenna 11 has high resistance to the influence of the ground existing in the surroundings, rather, uses the ground to perform matching. Thus, in the printed-circuit board 12, for example, as shown in FIG. 10, the printed antenna 11 is mounted in the vicinity of a ground required by other modules indicated by an oblique line part in the drawing.

Figure 11:
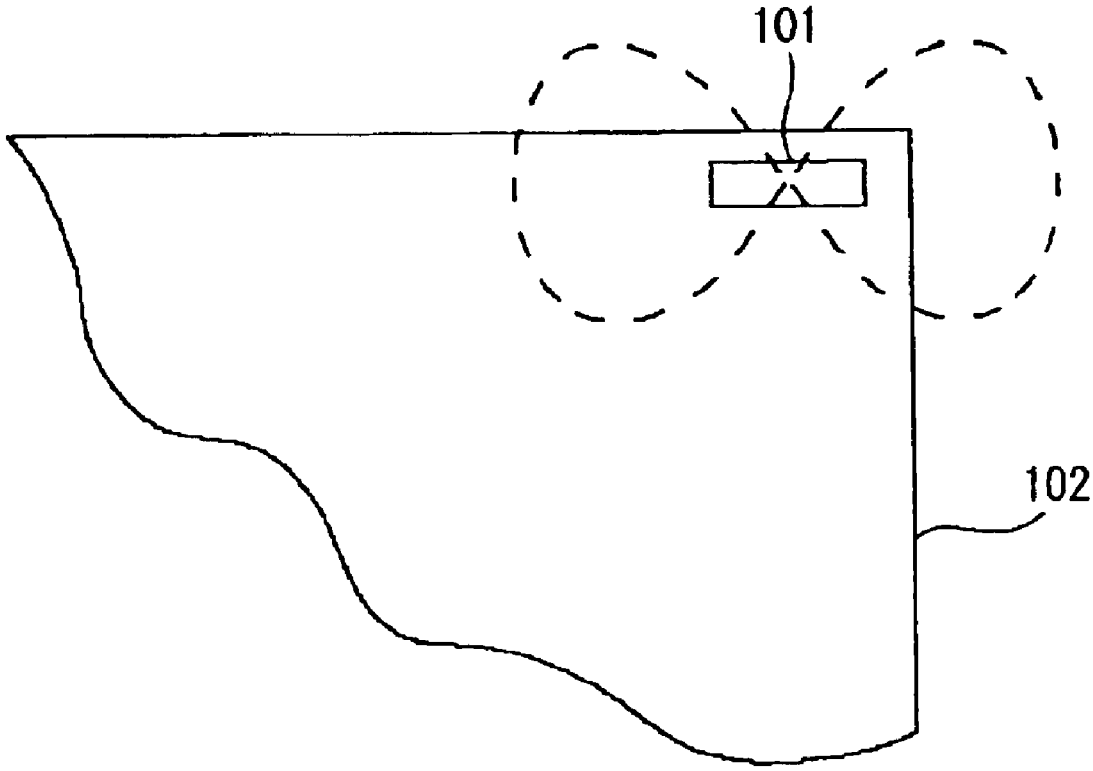
FIG. 11 is a plan view of a partial area in a conventional printed-circuit board on which a conventional antenna element is mounted and is the view for explaining an arrangement position of the antenna element on the printed-circuit board and a state of a radiation electric field at that time.

Here, consideration will be given to a case where an antenna element including a conventional printed antenna is mounted on a printed-circuit board. For example, as shown in FIG. 11, a conventional antenna element 101 is often mounted in an area close to a corner of a printed-circuit board 102 and in an area where ground does not exist in the surroundings. In this case, a radiation electric field comes to have an 8-shaped dipole mode as indicated by a broken line in the drawing. Accordingly, in the conventional antenna element 101, the half of electric power supplied is lost.

On the other hand, in the printed-circuit board 12, the ground is disposed so as to surround a remaining area of the surrounding area of the printed antenna 11 except a partial area. For example, in the printed-circuit board 12, as previously shown in FIG. 10, the ground is disposed so as to surround the surrounding area of at least three sides of the four sides forming the rectangular section in the printed antenna 11 having the section showing the rectangular shape. Then, in the printed-circuit board 12, the printed antenna 11 is disposed so that the remaining one side of the printed antenna 11 faces an edge portion of the printed-circuit board 12.

In the printed-circuit board 12, in the case where the printed antenna 11 and the surrounding ground are disposed as stated above, a current flows through the antenna conductors of the printed antenna 11, so that the vicinity of an area not surrounded by the ground in the surrounding area of the printed antenna 11, that is, the edge portion of the printed-circuit board 12 is excited. By this, in the printed-circuit board 12, the radiation electric field does not come to have a dipole mode, and as indicated by a broken line in the drawing, the radiation electric field is formed into a balloon shape to be radiated in one direction. That is, the printed-circuit board 12 can be operated so that the printed antenna 11 has directivity only in a specified direction.

Figure 12A:
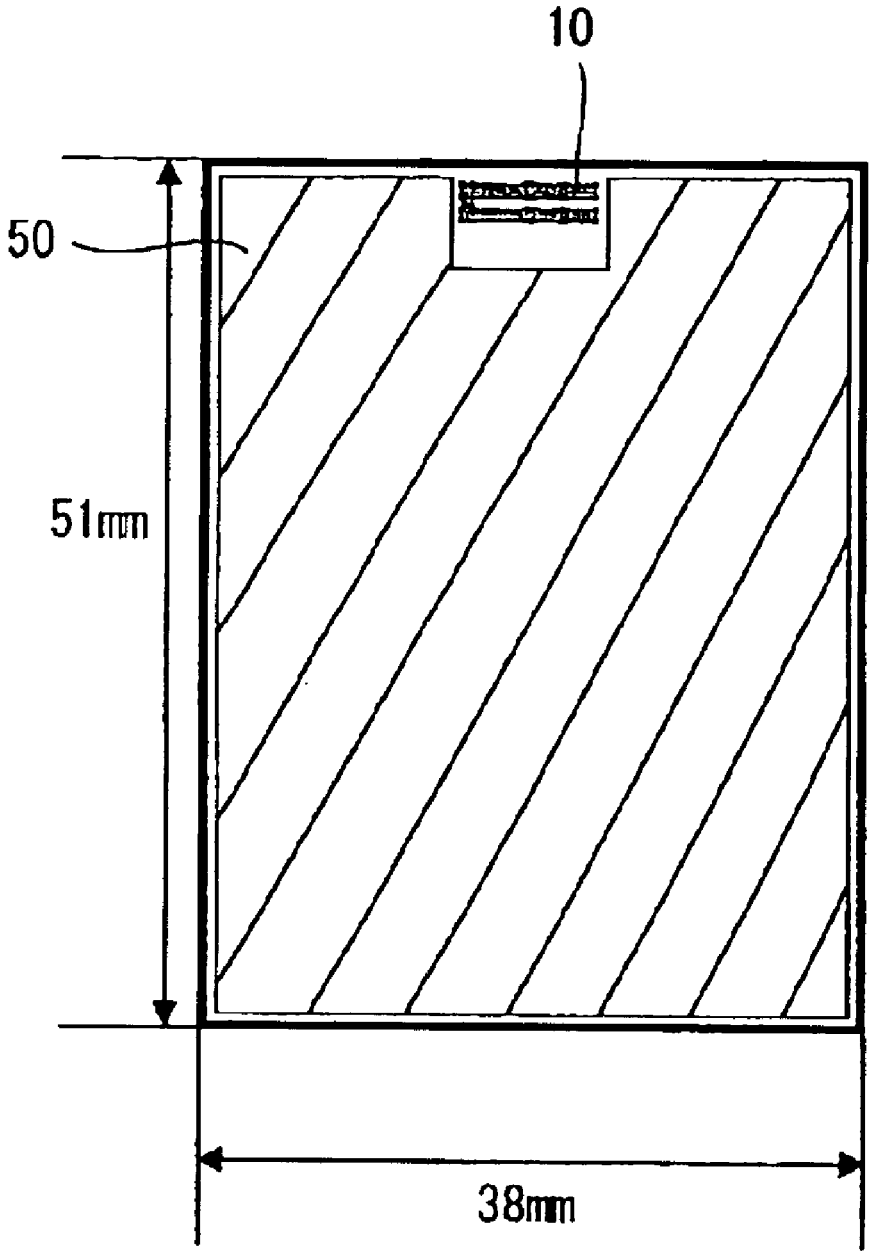
FIG. 12A is a view for explaining a structure of a printed-circuit board on which a printed antenna used for simulation is mounted and is the plan view of the printed-circuit board.
Figure 12B:
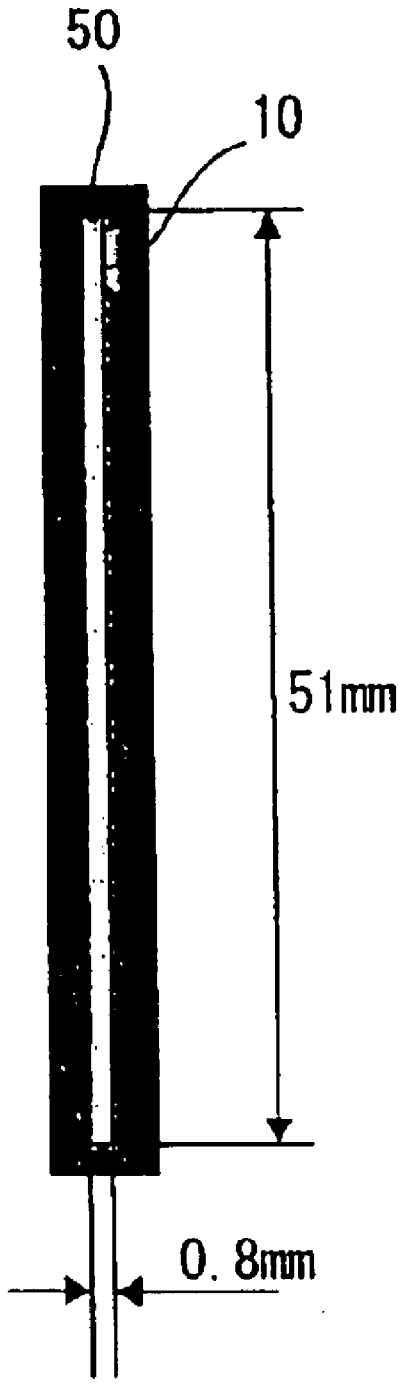
FIG. 12B is a view for explaining the structure of the printed-circuit board on which the printed antenna used for the simulation is mounted and is the side view of the printed-circuit board.

In order to specifically confirm the state of the directivity, the present applicant carried out a simulation using a specified printed-circuit board. As shown in a plan view of FIG. 12A and a side view of FIG. 12B, the simulation was carried out using the printed-circuit board 12 whose material was FR-4 and whose shape was a thin plate shape having a size of 51 mm long×38 mm broad×0.8 mm thick. Besides, in this simulation, as indicated by an oblique line part in FIG. 12A, a ground was disposed on the front and back surfaces of the printed-circuit board 12 so as to surround the surrounding area of three sides of four sides forming the rectangular section in the printed antenna 11 whose section is rectangular. Incidentally, since this simulation was carried out in order to verify the characteristic of the printed antenna 11, the four printed antennas 11 were not mounted on the printed-circuit board 12, and the one printed antenna 11 was mounted and the simulation was carried out.

Figure 13A:
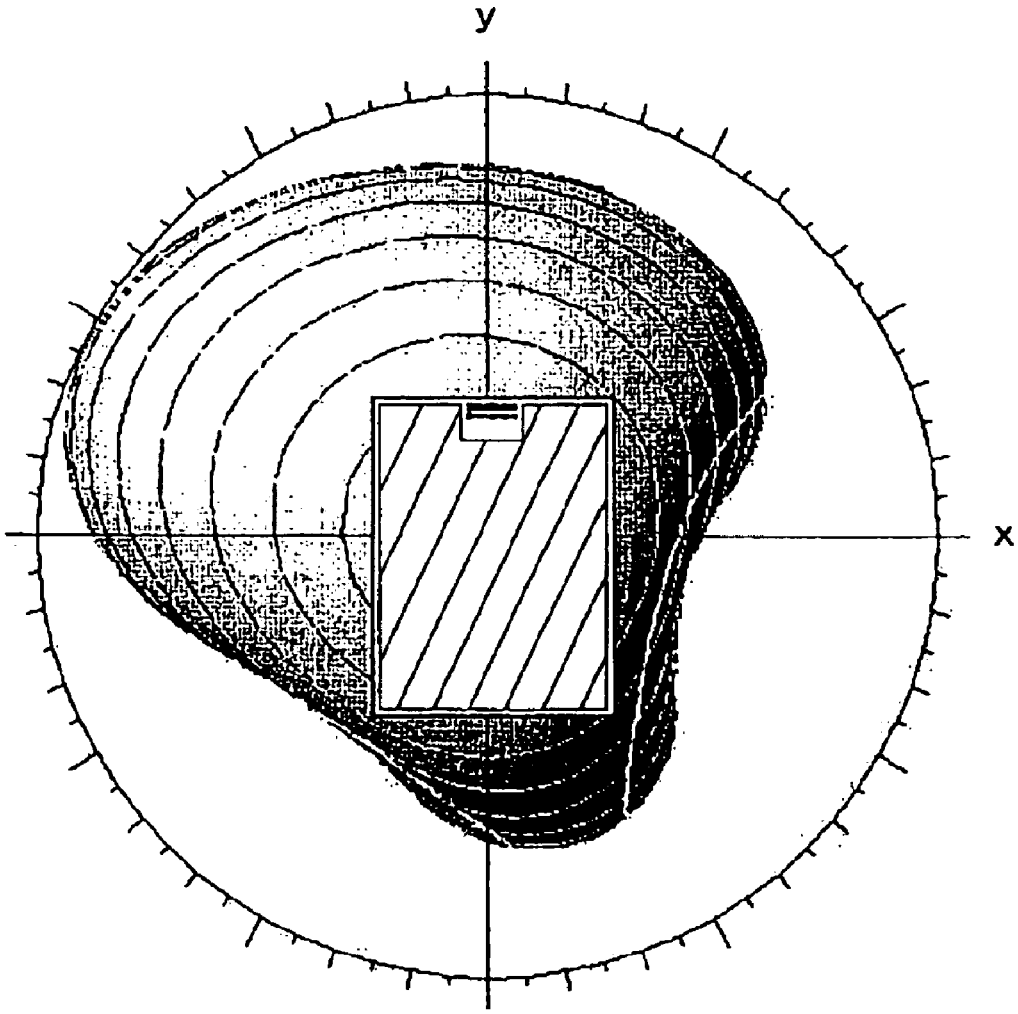
FIG. 13A is a contour map for explaining a state of a radiation electric field obtained by the simulation using the printed-circuit board shown in FIGS. 12A and 12B, and is the contour map corresponding to FIG. 12A and at the time when the printed-circuit board is seen from above.
Figure 13B:
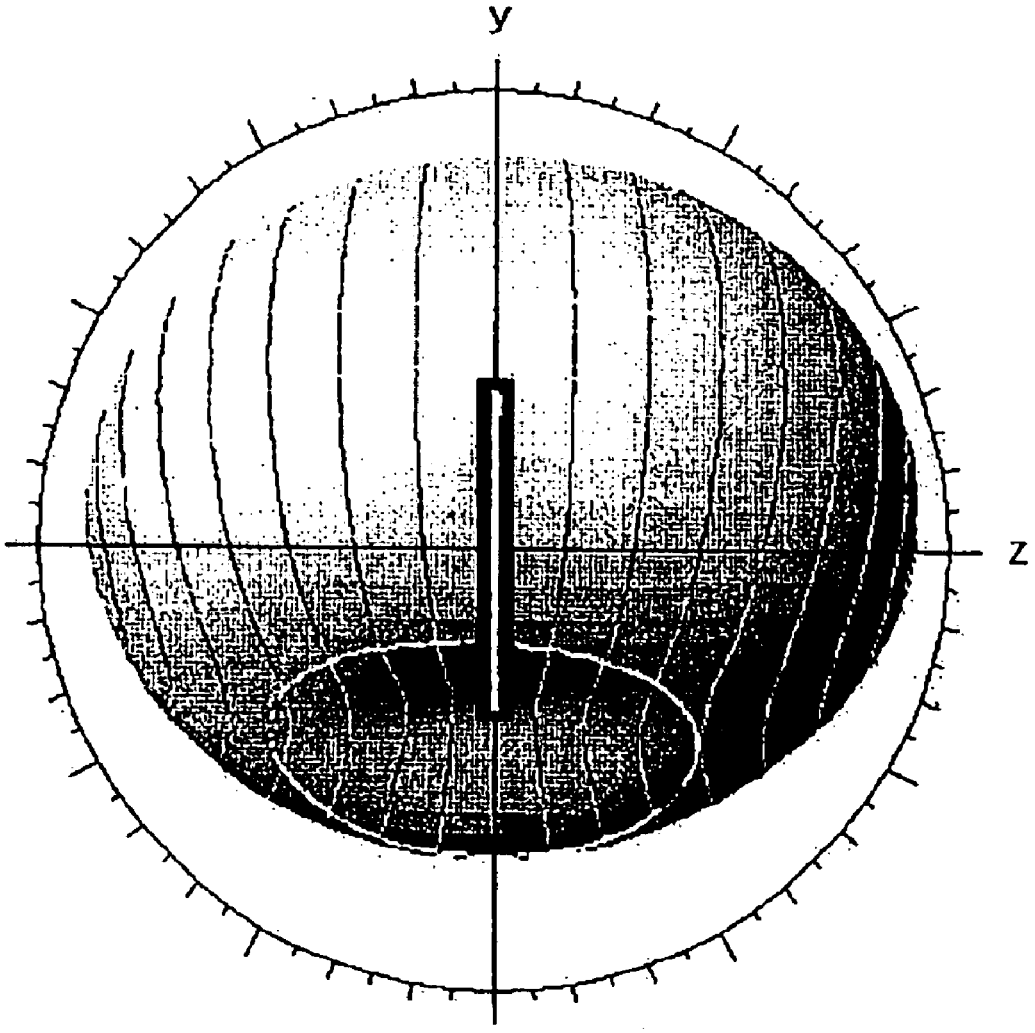
FIG. 13B is a contour map for explaining the state of the radiation electric field obtained by the simulation using the printed-circuit board shown in FIGS. 12A and 12B, and is the contour map corresponding to FIG. 12B and at the time when the printed-circuit board is seen from side.

In this case, a contour map of radiation electric field was evaluated, and a result as shown in FIGS. 13A and 13B was obtained. Incidentally, FIG. 13A corresponds to FIG. 12A and shows the radiation electric field when the printed-circuit board 12 is viewed from above, and FIG. 13B corresponds to FIG. 12B and shows the radiation electric field when the printed-circuit board 12 is viewed from side. Besides, in FIG. 13, the horizontal direction of the printed-circuit board 12 is an x-axis, the vertical direction is a y-axis, and the thickness direction is a z-axis.

From the drawings, it is understood that the radiation electric field is apparently different from the 8-shaped dipole mode, and is formed into a balloon shape expanding in the +y direction on the x-y plane while the printed-circuit board 12 is made a radiation source. Incidentally, from this result, a gain of about 2.06 dBi was obtained. For example, in the case where the printed-circuit board 12 is applied to a LAN card, although the −x direction becomes a loss direction, since it is small as compared with the +y direction, it is understood that the printed-circuit board 12 efficiently uses the electric power supplied.

As stated above, in the printed-circuit board 12, the ground is disposed so as to surround the remaining area of the surrounding area of the printed antenna 11 except the partial area, so that a large loss of electric power supplied to the printed antenna 11 can be avoided and the electric power can be effectively used, and further, excellent directivity can be realized, and sensitivity can be raised. In the printed-circuit board 12, it is unnecessary to provide a dedicated land in which ground required by other modules does not exist, and it is unnecessary to design the antenna element itself on the assumption that the ground does not exist in the surroundings, and a quite new concept is proposed in design guideline.

The foregoing PDA 10 incorporates the printed-circuit board 12 on which the printed antenna 11 as stated above is mounted. In other words, the PDA 10 incorporates a circularly polarized antenna constructed by two linearly polarized antennas receiving linearly polarized signals and a ground edge portion. By this, the PDA 10 can resolve the foregoing problem of the diversity and interference.

Figure 14:
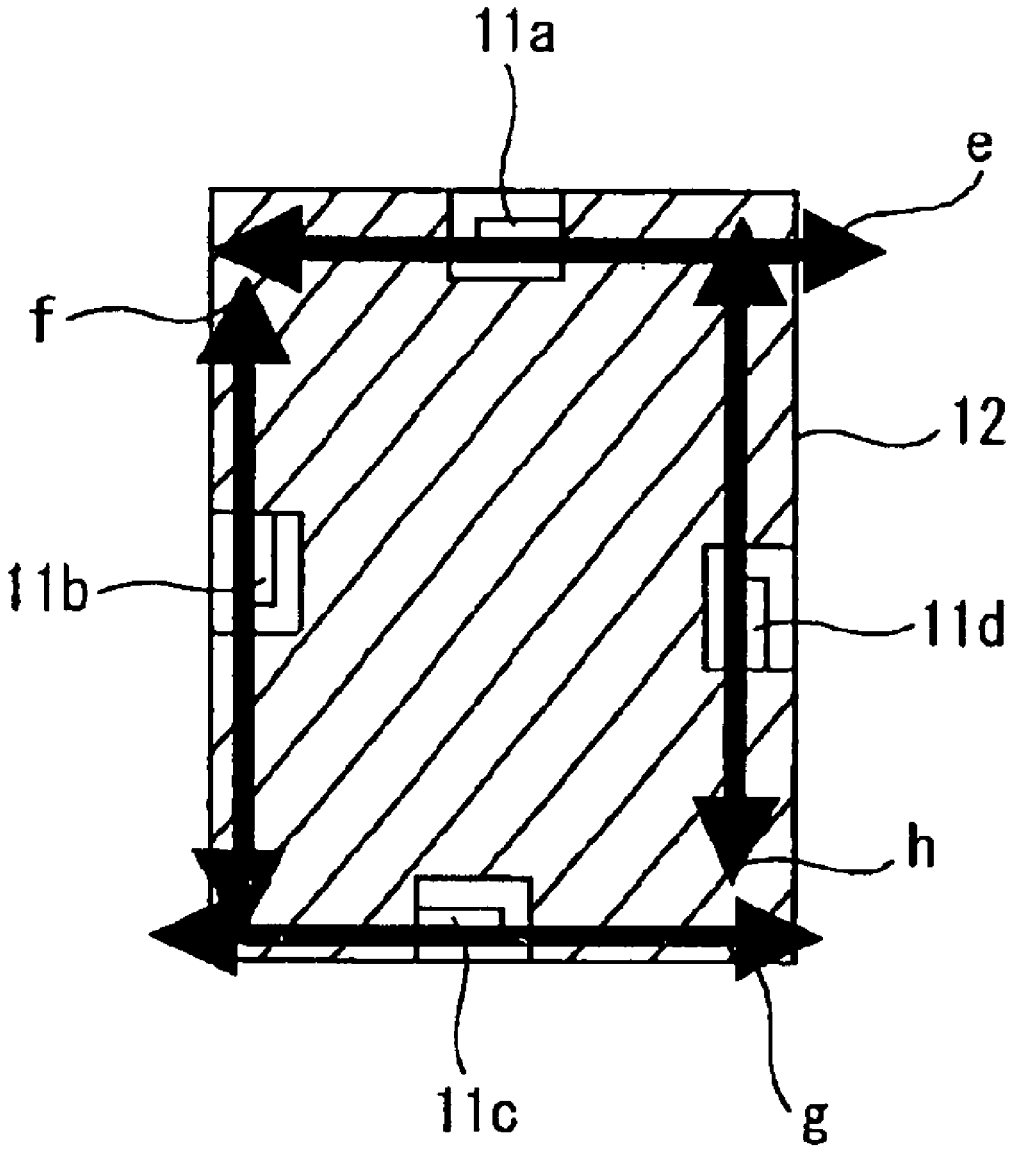
FIG. 14 is a plan view of a printed-circuit board on which four printed antennas are mounted, and is the view for explaining a state in which the printed antennas are disposed such that a surrounding area of at least three sides in each of the four printed antennas is surrounded by a ground, and a remaining one side faces an edge portion of the printed-circuit board.

That is, in the PDA 10, as shown in FIG. 14, the printed antennas 11*a*, 11*b*, 11*c* and 11*d* are disposed on the printed-circuit board 12 so that the ground indicated by an oblique line part in the drawing surrounds a surrounding area of at least three sides in each of the printed antennas 11*a*, 11*b*, 11*c* and 11*d*, and a remaining one side faces an edge portion of the printed-circuit board 12.

Here, when consideration is given to the diversity of the circularly polarized antenna formed by combining the printed antennas 11*a*, 11*b*, 11*c* and 11*d* on the printed-circuit board 12 as stated above, since the printed antennas 11*a*, 11*b*, 11*c* and 11*d* respectively have high directivity, in addition to a spatial diversity effect, a directional diversity effect can also be obtained.

Besides, as described above, each of the printed antennas 11*a*, 11*b*, 11*c* and 11*d* excites the edge portion of the printed-circuit board 12. Accordingly, resonance by the printed antenna 11*a* occurs in a direction indicated by an arrow e in the drawing, resonance by the printed antenna 11*b* occurs in a direction indicated by an arrow f in the drawing, resonance by the printed antenna 11*c* occurs in a direction indicated by an arrow g in the drawing, and resonance by the printed antenna 11*d* occurs in a direction indicated by an arrow h in the drawing. As stated above, in the PDA 10, since the resonance by each of the printed antennas 11*a*, 11*b*, 11*c* and 11*d* occurs at the edge portion of the printed-circuit board 12 where each of them is positioned, it is possible to reduce the interference between one of the printed antennas 11*a*, 11*b*, 11*c* and 11*d* and the printed antenna positioned at another edge portion different from the edge portion where the one printed antenna itself is positioned.

As described above, the PDA 10 described as the embodiment of the invention includes the printed antennas 11*a*, 11*b*, 11*c* and 11*d* receiving the linearly polarized signals, and among these printed antennas 11*a*, 11*b*, 11*c* and 11*d*, the two printed antennas 11*a* and 11*b* are disposed along axes orthogonal to each other and are constructed so as to respectively receive signals in which polarization planes are orthogonal to each other and the phases are different by 90°, and the two remaining printed antennas 11*c* and 11*d* are disposed along axes orthogonal to each other and are constructed so as to respectively receive signals in which the polarization planes are orthogonal to each other and the phases are different by 90°. Accordingly, as compared with a case where conventional patch antennas are mounted, especially the length in the thickness direction can be reduced, and while the circularly polarized signal can be received under the characteristic similar to the case where the conventional patch antennas are mounted, great miniaturization can be realized.

Besides, the PDA 10 includes the printed antennas 11*a*, 11*b*, 11*c* and 11*d* in which the open end is formed by the two antenna conductors 51 and 56, so that these printed antennas 11*a*, 11*b*, 11*c* and 11*d* can be respectively treated as ones which are not easily influenced by the ground existing in the surroundings, rather, actively use the ground existing in the surroundings to perform matching. Thus, in the PDA 10, at the design stage of layout, it is not necessary to provide a dedicated land in which a ground required by other modules does not exist, so that the flexible layout becomes possible, and besides, the ground is disposed so as to surround the remaining area, except a partial area, of the surrounding area of each of the printed antennas 11*a*, 11*b*, 11*c* and 11*d* in which the open end as stated above is formed, so that superior directivity is realized in the respective printed antennas 11*a*, 11*b*, 11*c* and 11*d*, the effects of not only spatial diversity but also directional diversity are obtained, the interference due to the mounting of the plural printed antennas 11*a*, 11*b*, 11*c* and 11*d* is reduced, and very effective reception can be carried out.

As stated above, the PDA 10 facilitates the miniaturization, can greatly expand the degree of freedom in layout, and is very effective in a situation where the design and power limitation are severe.

Further, since the PDA 10 incorporates the printed antennas 11*a*, 11*b*, 11*c* and 11*d* using the inexpensive printed-circuit board as the base member, the working of the antenna element is easy, and besides, it becomes possible to manufacture the antenna element by using the manufacture process of the printed-circuit board 12, and the whole manufacture cost can be greatly reduced.

Incidentally, the invention is not limited to the foregoing embodiment. For example, in the foregoing embodiment, although the description has been given to the structure in which the two printed antennas 11*a* and 11*b* respectively receive the signals in which the polarization planes are orthogonal to each other, and the two remaining printed antennas 11*c* and 11*d* receive the signals in which the polarization planes are orthogonal to each other, the polarization planes of the signals may not be always orthogonal to each other. This is because the shift of the polarization plane from orthogonality can be compensated by the shift of the phase. Accordingly, the structure may be such that the linearly polarized signals are respectively received by two antenna elements, and more desirably, the structure may be such that two different signals in which the polarization planes are orthogonal to each other are received.

Besides, in the foregoing embodiment, although the description has been given on the assumption that the four printed antennas 11*a*, 11*b*, 11*c* and 11*d* are mounted, this is for realizing the same effect as the environment in which the diversity effect is obtained by mounting two patch antennas. Accordingly, the invention can be applied to any case as long as at least one antenna element pair is mounted in which two antenna elements for receiving linearly polarized signals, which have polarization planes orthogonal to each other and phases different by 90°, are disposed along axes orthogonal to each other.

Further, in the foregoing embodiment, although the description has been given on the assumption that the printed antenna is used as the antenna element, the invention is not limited to the printed antenna, and any antenna element can be applied as long as it is a chip-like antenna element which can be surface-mounted on the printed-circuit board.

Figure 15:
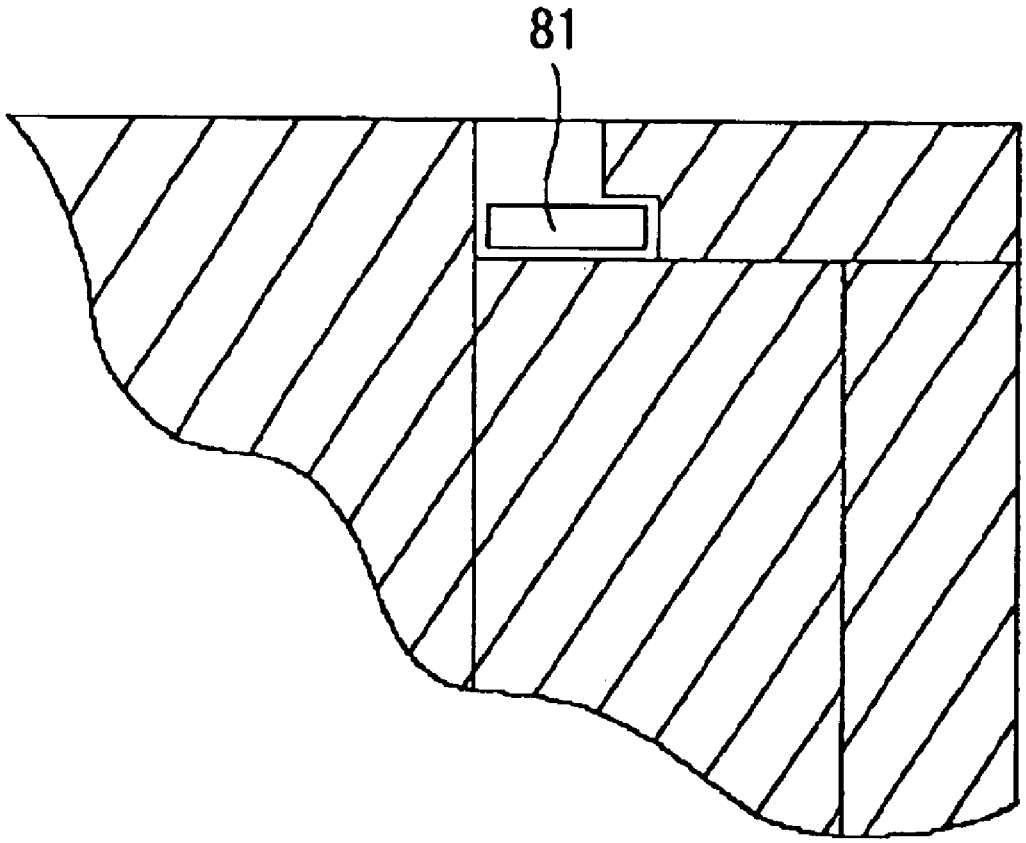
FIG. 15 is a plan view of a partial area in a printed-circuit board formed of a layout different from the printed-circuit board shown in FIG. 10.

Furthermore, in the foregoing embodiment, although the description has been given to the case where the section of the printed antenna shows the rectangular shape, and in this case, the ground is disposed so as to surround the surrounding area of the three sides of the four sides forming the rectangular section in the printed antenna, in the case where the section of the antenna element shows the rectangular shape, for example, as indicated by an oblique line part in FIG. 15, the invention may be such that a ground is disposed so as to surround a surrounding area of a part of a remaining one side in addition to a surrounding area of three sides of four sides forming the rectangular section in an antenna element 81, and the one side is disposed to face an edge portion of a print-circuit board, and the invention can be applied to any arrangement as long as a ground is disposed so as to surround a surrounding area of at least three sides of four sides forming a rectangular section in an antenna element, and a remaining one side faces an edge portion of a printed-circuit board.

Further, in the foregoing embodiment, although the description has been given to the printed antenna in which a series of conductor patterns are formed such that plural antenna conductors connected to each other to form a meandering shape (comb teeth shape) through plural through holes are bent into substantially a C shape, in the invention, as the conductor pattern of the antenna element, any pattern can be applied under the condition that matching to the surrounding ground is suitably performed, for example, one in which a multi-layer substrate is used and a specified conductor pattern including an open end is formed, can also be applied.

In any case, as an antenna element, any element may be used as long as an open end is formed of at least two antenna conductors separated from each other under the condition that matching to the surrounding ground is suitably performed, and more desirably, any element may be used as long as a conductor pattern showing a three-dimensional structure is formed. Besides, at this time, as an antenna element, an open end may not be formed by disposing at least two antenna conductors to be separated from each other in a height direction, but may be formed by disposing the two antenna conductors to have the same height and to be separated from each other on a plane.

Further, in the foregoing embodiment, although the description has been given while focusing on the reception of signals by the printed antennas 11*a*, 11*b*, 11*c* and 11*d*, it is needless to say that these printed antennas 11*a*, 11*b*, 11*c* and 11*d* can transmit signals.

Furthermore, in the foregoing embodiment, although the description has been given while the PDA 10 is used as a specific example of an electronic equipment, it is needless to say that the invention can be applied to any electronic equipment including, for example, a cellular phone.

As stated above, it is needless to say that the invention can be suitably modified within the scope not deviating from the gist. Specific embodiments of Electronic Equipment And Antenna Mounting Printed-Circuit Board according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. An electronic equipment having at least a communication function, comprising:

a printed-circuit board on which at least one antenna element pair including two chip-like antenna elements, each of which transmits and/or receives a linearly polarized signal and which are disposed along axes orthogonal to each other, and various modules for realizing various functions are mounted, wherein each of the antenna elements has a thin plate shape having a rectangular section, an open end is formed by at least two antenna conductors separated from each other; and a ground required by one or plural other modules is disposed to surround a surrounding area of at least three sides of four sides forming the rectangular section in each of the antenna elements, and the antenna elements are disposed and mounted so that a remaining one side of the four sides forming the rectangular section in each of the antenna elements faces an edge portion of the printed-circuit board.

2. The electronic equipment according to claim 1, wherein the two antenna elements constituting the antenna element pair respectively transmit and/or receive linearly polarized signals different from each other in polarization plane.

3. The electronic equipment according to claim 2, wherein the two antenna elements constituting the antenna element pair respectively transmit and/or receive linearly polarized signals in which polarization planes are orthogonal to each other.

4. The electronic equipment according to claim 1, wherein one of the two antenna elements constituting the antenna element pair transmits and/or receives a first linearly polarized signal, and the other antenna element transmits and/or receives a second linearly polarized signal different from the first signal in phase by 90°.

5. The electronic equipment according to claim 1, wherein the at least two antenna conductors are separated from each other in a height direction.

6. The electronic equipment according to claim 1, wherein each of the two antenna elements constituting the antenna element pair is constructed such that a conductor pattern having a three-dimensional structure is formed in a specified resin substrate.

7. The electronic equipment according to claim 6, wherein each of the two antenna elements constituting the antenna element pair, the conductor pattern is formed such that plural antenna conductors are connected to each other to enable electrical conduction through one or plural through holes which are provided to be bored through the resin substrate from a front surface to a back surface and whose insides are coated with copper foils.

8. The electronic equipment according to claim 7, wherein each of the two antenna elements constituting the antenna element pair, the plural antenna conductors are connected to form a meandering shape through the one or plural through holes so that the conductor pattern is formed.

9. The electronic equipment according to claim 6, wherein the resin substrate is made of a glass cloth epoxy substrate.

10. An antenna mounting printed-circuit board which is incorporated in an equipment having at least a communication function and on which various modules for realizing various functions are mounted, comprising:

at least one antenna element pair in which two chip-like antenna elements each transmitting and/or receiving a linearly polarized signal are disposed along axes orthogonal to each other;

a ground which is disposed to surround a surrounding area of at least three sides of four sides forming a rectangular section in each of the antenna elements each having a thin plate shape with a section of a rectangular shape and is required by one or plural other modules, are mounted; and an open end of each of the antenna elements is formed of at least two antenna conductors separated from each other, and a remaining one side of the four sides forming the rectangular section is disposed to face an edge portion of the printed-circuit board.

11. The antenna mounting printed-circuit board according to claim 10, wherein the two antenna elements constituting the antenna element pair respectively transmit and/or receive linearly polarized signals different from each other in polarization plane.

12. The antenna mounting printed-circuit board according to claim 11, wherein the two antenna elements constituting the antenna element pair respectively transmit and/or receive linearly polarized signals in which polarization planes are orthogonal to each other.

13. The antenna mounting printed-circuit board according to claim 10, wherein one of the two antenna elements constituting the antenna element pair transmits and/or receives a first linearly polarized signal, and the other antenna element transmits and/or receives a second linearly polarized signal different from the first signal in phase by 90°.

14. The antenna mounting printed-circuit board according to claim 10, wherein the at least two antenna conductors are separated from each other in a height direction.

15. The antenna mounting printed-circuit board according to claim 10, wherein each of the two antenna elements constituting the antenna element pair is constructed such that a conductor pattern showing a three-dimensional structure is formed in a specified resin substrate.

16. The antenna mounting printed-circuit board according to claim 15, wherein each of the two antenna elements constituting the antenna element pair, the conductor pattern is formed such that plural antenna conductors are connected to each other to enable electrical conduction through one or plural through holes which are provided to be bored through the resin substrate from a front surface to a back surface and whose insides are coated with copper foils.

17. The antenna mounting printed-circuit board according to claim 16, wherein each of the two antenna elements constituting the antenna element pair, the plural antenna conductors are connected to form a meandering shape through the one or plural through holes so that the conductor pattern is formed.

18. The antenna mounting printed-circuit board according to claim 15, wherein the resin substrate is made of a glass cloth epoxy substrate.

* * * * *